United States Patent [19]

Favrot

[11] 4,330,962

[45] May 25, 1982

[54] ASSEMBLY OF GRINDING-WHEELS OF GRINDING MACHINES

[75] Inventor: Paul Favrot, Gagny, France

[73] Assignee: Constructions De Clichy, France

[21] Appl. No.: 160,727

[22] Filed: Jun. 18, 1980

Related U.S. Application Data

[63] Continuation of Ser. No. 961,682, Nov. 17, 1978, abandoned.

[30] Foreign Application Priority Data

Nov. 22, 1977 [FR] France ..... 77 34989

[51] Int. Cl.[3] ..... B24B 5/04; B24B 53/04

[52] U.S. Cl. ..... 51/5 D; 51/168; 51/95 WH; 125/11 CD

[58] Field of Search ..... 51/95 R, 95 WH, 99, 51/168, 236, 72 R, 5 D; 125/11 CD; 83/481, 564

[56] References Cited

U.S. PATENT DOCUMENTS

| | | | |
|---|---|---|---|
| 70,788 | 11/1867 | Birch | 51/236 |
| 252,114 | 1/1882 | Marshall | 83/481 |
| 974,039 | 10/1910 | Dolan | 83/481 |
| 2,109,057 | 2/1938 | Bilcker et al. | 83/481 |
| 2,286,046 | 6/1942 | Wickman | 125/11 CD |
| 3,006,332 | 10/1961 | Cooper | 125/11 CD |
| 3,113,563 | 12/1963 | Hughes | 125/11 CD |
| 3,422,578 | 1/1969 | Mossman et al. | 51/168 |

*Primary Examiner*—Harold D. Whitehead
*Assistant Examiner*—K. Bradford Adolphson
*Attorney, Agent, or Firm*—Pigott, Gerstman & Ellis, Ltd.

[57] ABSTRACT

The grinding machine comprises a frame, a stationary table for supporting a grinding-wheel carriage, and a bed for supporting a movable table. The workpiece to be ground is mounted between a headstock and a tailstock which are carried by the movable table. The grinding-wheel is fixed on a sleeve which is freely mounted for rotation on a shaft, the two ends of which are rigidly fixed respectively in two supports mounted on the grinding-wheel carriage directly above the carriage slideways.

2 Claims, 7 Drawing Figures

101
102
103
104
105
23
25
26
21
28
27
29
35
32
34
33
95
23

ASSEMBLY OF GRINDING-WHEELS OF GRINDING MACHINES

CROSS REFERENCE TO RELATED APPLICATION

This application is a continuation of U.S. application Ser. No. 961,682, filed Nov. 17, 1978, (abandoned).

BACKGROUND OF THE INVENTION

This invention relates to a grinding machine comprising a frame having an upper portion in the form of a stationary table for carrying a grinding-wheel slide or carriage, and a bed provided with slideways in the upper portion thereof in order to support a moving table for carrying the headstock and tailstock between which is mounted the workpiece to be ground.

In known machines of this type, the grinding-wheel is mounted in overhung position on one end of a shaft which is rotatably mounted in a long bearing fixed on the grinding-wheel carriage (slide). In the first place, an overhung or cantilevered form of structural design has never been considered as truly rational, especially in the case of high-precision machines (in which tolerances are limited to less than one micron). In the second place, further disadvantages arise from the known type of construction under consideration. The grinding-wheel is in fact displaced on one side to a point located outside all the slideways and the lines of connection between the bearing points of the grinding-wheel shaft and the frame are of relatively substantial length; this is a cause of deformations which are liable to have an adverse effect on the desired standard of accuracy. Furthermore, the dressing-wheel which is employed for truing the grinding-wheel and the work plane of which must necessarily be located in the plane of the grinding-wheel is also displaced laterally on the grinding-wheel carriage and also mounted in overhung position. This again results in relatively long lines of connection between the grinding-wheel shaft and the dressing-wheel shaft.

SUMMARY OF THE INVENTION

The aim of the invention is to improve the assembly design of the wheels of grinding machines in order to overcome the above-mentioned disadvantages of the conventional overhung grinding-wheel design.

To this end and in accordance with the main characteristic feature of the invention, the grinding-wheel is fixed on a sleeve which is freely mounted for rotation on a shaft, the two ends of said shaft being rigidly fixed respectively in two supports mounted on the grinding-wheel carriage directly above the slideways of said carriage.

By virtue of this particular structural arrangement, the grinding-wheel is no longer in an overhung position. This is not only more rational but also reduces the overall transverse dimensions of the bearings since these latter are replaced by the less cumbersome arrangement of a sleeve which is rotatably mounted on a stationary shaft. Moreover, the two bearings of the grinding-wheel shaft are located directly above the slideways of the grinding-wheel carriage, that is to say under the best conditions for transmission of forces to the frame of the machine by means of connections of minimum length.

In an advantageous embodiment in which the machine is provided with a wheel for dressing the grinding-wheel which is rigidly fixed to a rotary shaft, this latter is rotatably mounted in two bearings fixed on a dressing-wheel carriage having slideways which are located respectively in vertically overhead relation to the slideways of the grinding-wheel carriage. Thus it is apparent in this embodiment, not only that the dressing-wheel is no longer mounted in overhung position as is the case in conventional machines but that the lines of connection between the grinding-wheel shaft and the dressing-wheel shaft are also reduced to the strict minimum.

In a particular form of construction of the invention, two side-arms of a yoke are engaged on the two ends of the shaft which carries the grinding-wheel and one of said side-arms is removable. The yoke body which supports a motor for driving the grinding-wheel in rotation by means of a belt drive system is fixed on one end of two rocker-arms which are pivotally mounted respectively against the two lateral faces of the grinding-wheel carriage. Thus, when the pair of rocker-arms is pivotally displaced upwards and towards the rear of the machine together with the yoke, the grinding-wheel and the motor, this assembly is moved into a zone which is both clean and accessible. After detaching the removable side-arm of the yoke, it is accordingly possible to change the grinding-wheel under the best conditions and consequently in the minimum time.

BRIEF DESCRIPTION OF THE DRAWINGS

A more complete understanding of the invention will be obtained from the following description and from the accompanying drawings in which one embodiment of an improved production grinding machine in accordance with the invention is shown by way of example, as in which.

DETAILED DESCRIPTION OF THE INVENTION

Figure 1:
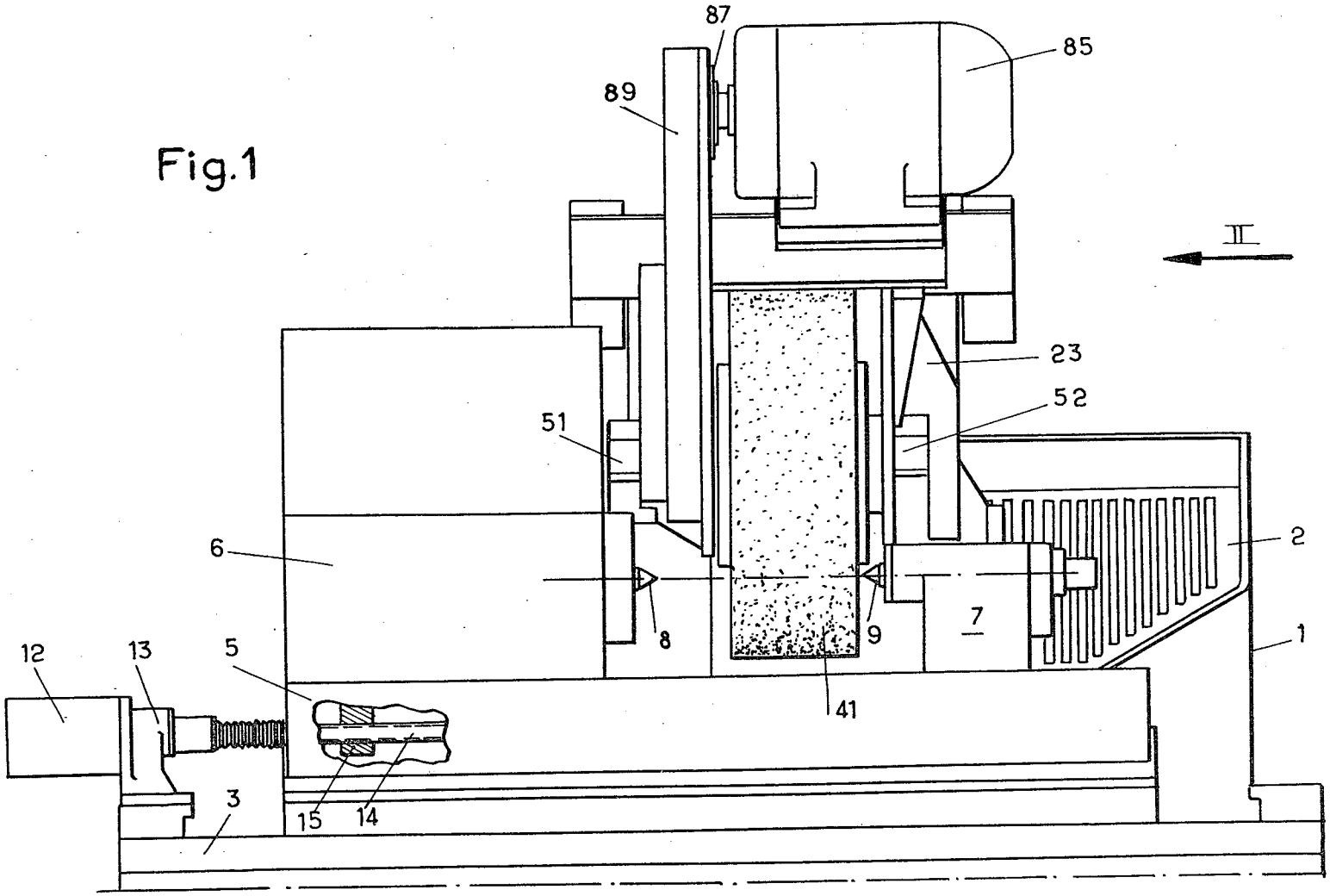
FIG. 1 is a front view of the complete grinding machine.
Figure 2:
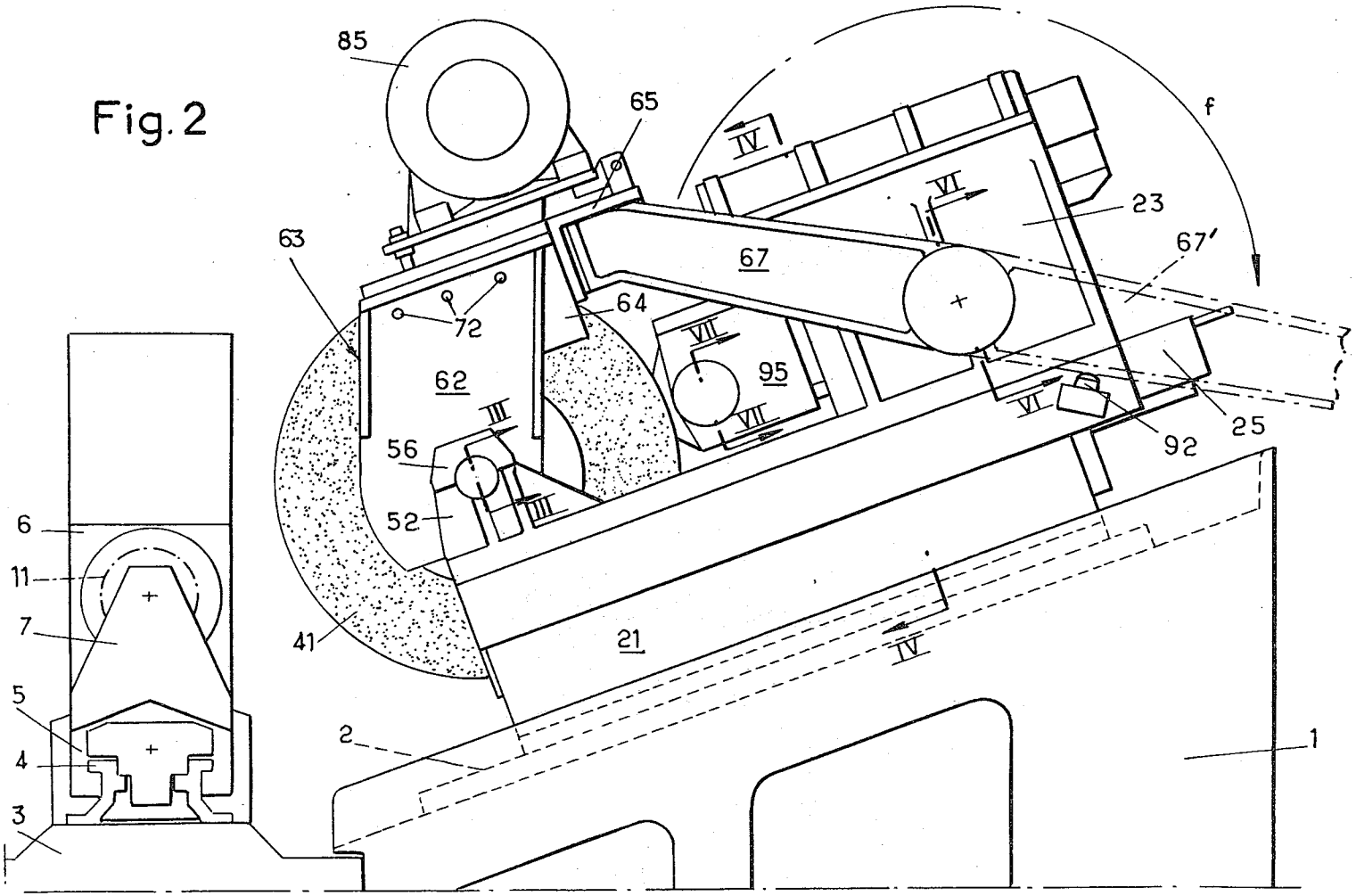
FIG. 2 is a profile view looking in the direction of the arrow II of FIG. 1.

The production grinding machine which is generally illustrated in FIGS. 1 and 2 essentially comprises a frame 1 whose upper portion forms a stationary work-table 2 which is inclined in this example both forwards and downwards through an angle of approximately 20° and a bed 3 whose upper portion is provided with slideways 4 for supporting a movable work-table 5 which carries the headstock 6 and the tailstock 7. Said headstock and tailstock are provided respectively with centers 8 and 9 between which can be mounted the workpiece 11 to be ground. The table is displaced along slideways by means of a drive system comprising a stepping motor 12 having two directions of rotation and carried by support 13 on the bed 3, and a screw 14 engaged with a nut 15 which is rigidly fixed to the table 5.

Figure 4:
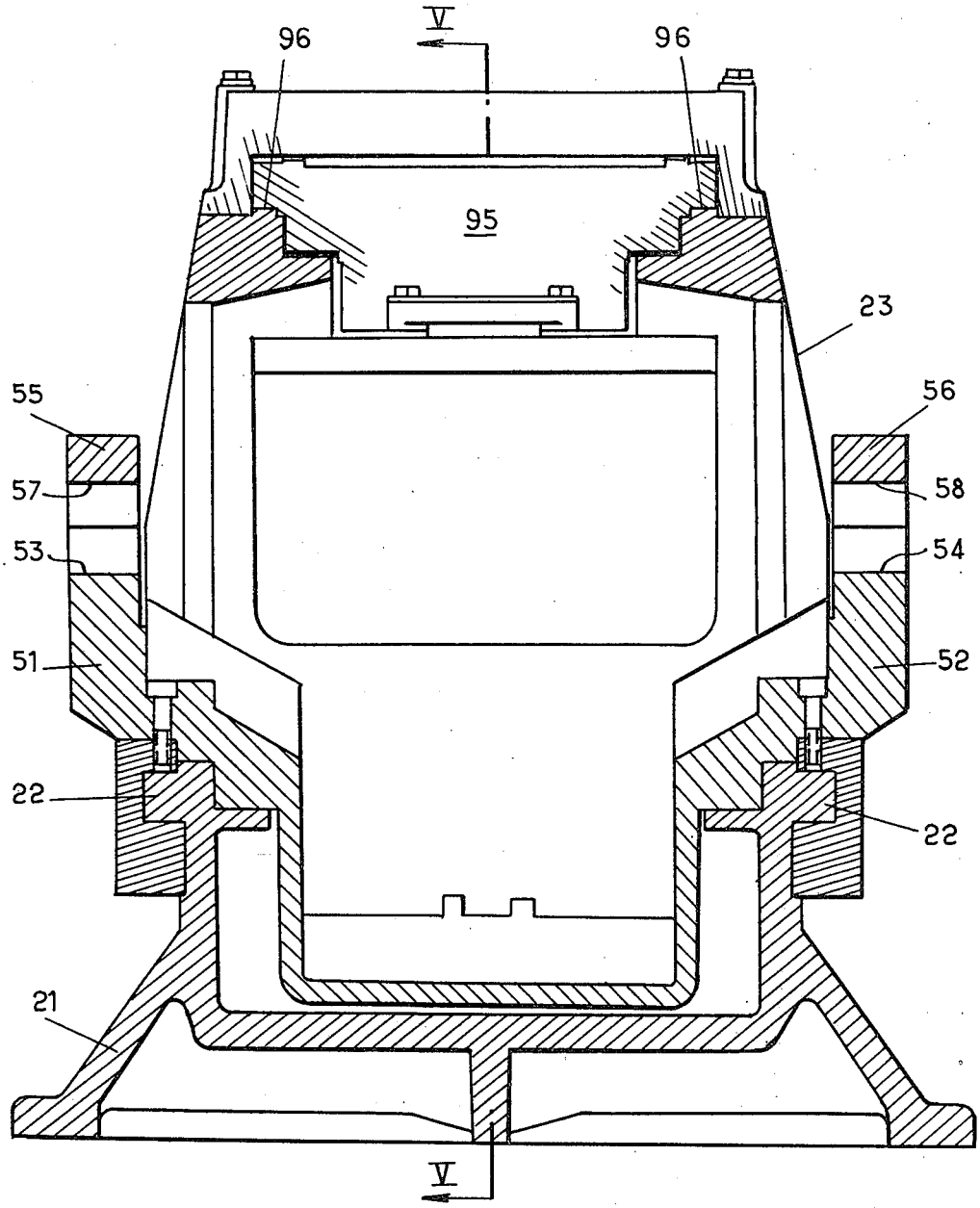
FIG. 4 is a sectional view to a larger scale which is taken along the line IV—IV of FIG. 2 and shows only the assembly design of the grinding-wheel and dressing-wheel carriages.
Figure 5:
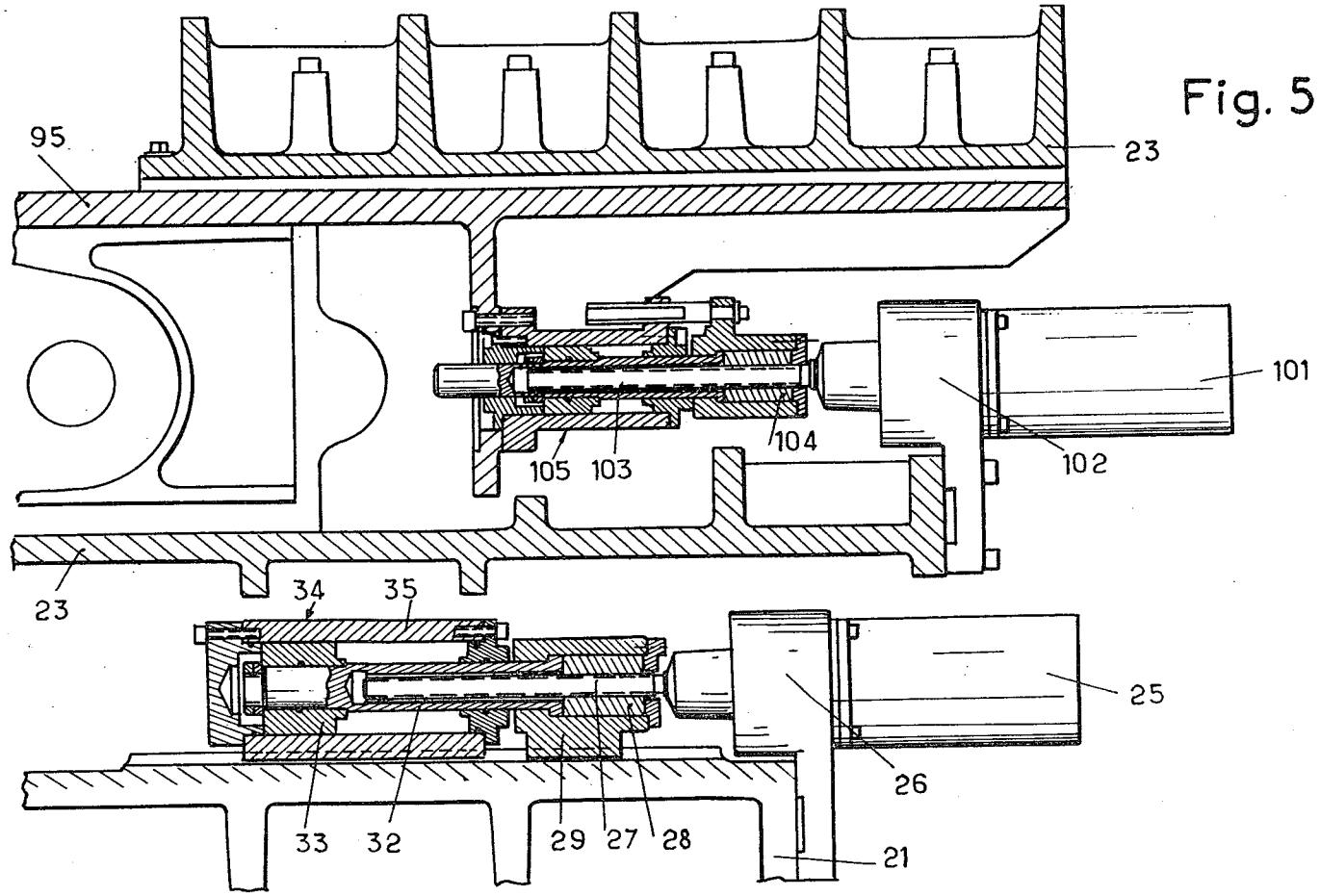
FIG. 5 is a sectional view taken along line V—V of FIG. 4 and shows the means for controlling the motion of said carriages.

On the stationary table 2 is bolted a slide plate 21 provided with slideways 22 (FIG. 4) on which is slidably mounted a grinding-wheel carriage 23 under the action of a drive system comprising: a stepping motor 25 (FIG. 5) having two directions of rotation and carried by the slide plate 21 (as also shown in FIG. 5), a reduction-gear unit 26, a screw 27 rigidly fixed to the output shaft of said reduction-gear unit, a nut 28 engaged on said screw and fixed within a shoe 29 which is capable of sliding without rotating on the slide plate 21, a rod 32 rigidly fixed to the shoe 29, a piston 33 rigidly fixed to said rod and forming part of a hydraulic jack generally designated by the reference 34, the jack cylinder 35 being rigidly fixed to the grinding-wheel carriage 23.

Figure 3:
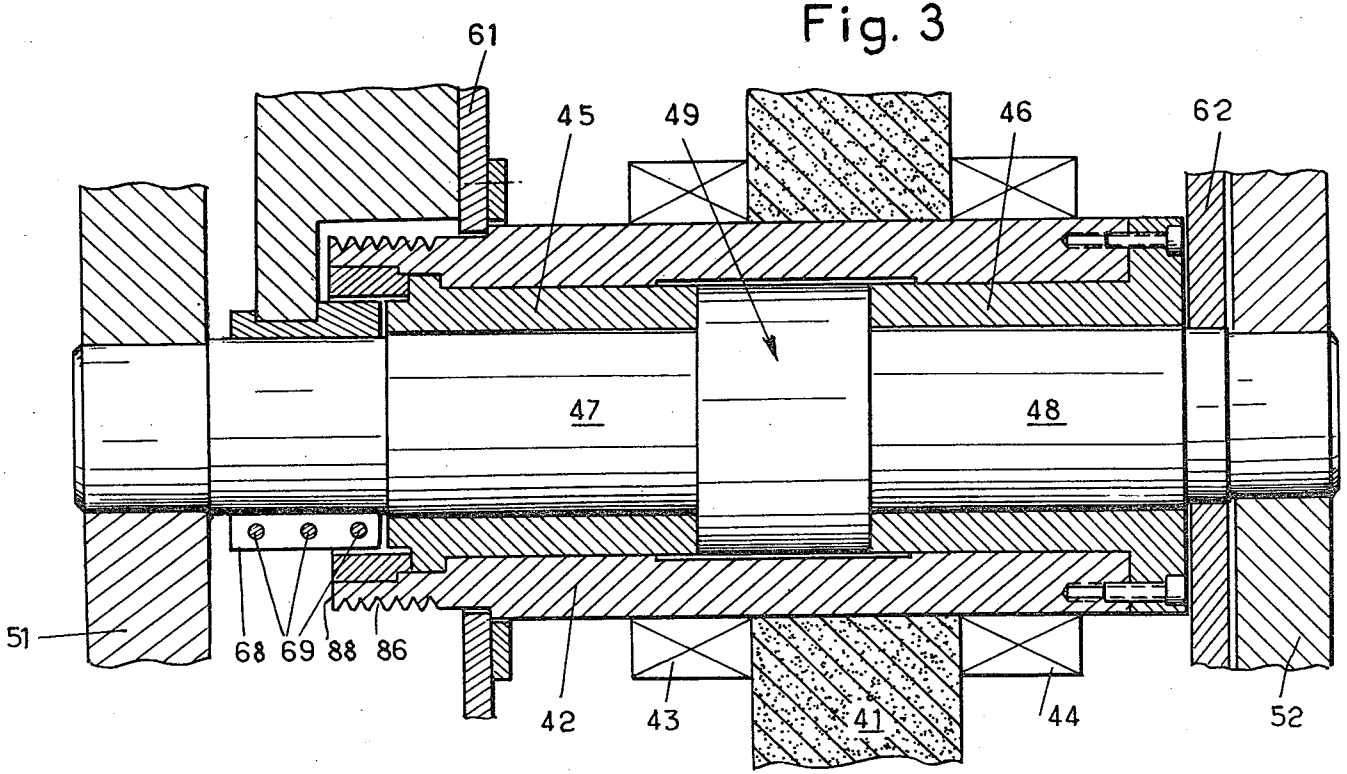
FIG. 3 is a part-sectional view taken along the axis of the grinding-wheel and along line III—III of FIG. 2.

The grinding-wheel 41 is fixed on a sleeve 42 (FIG. 3) by any suitable and conventional means such as conical rings designated by the references 43, 44. The sleeve 42 is pivotally mounted by means of two end members 45, 46 rigidly fixed thereto on two cylindrical bearing surfaces 47, 48 of a stationary shaft 49 in such a manner as to constitute in practice two fluid bearings in accordance with a conventional technique which will not be explained in detail in this description. The two ends of the shaft 49 are clamped in two supports 51, 52 (as also shown in FIG. 4) in which are formed semi-cylindrical housings 53, 54 and which are rigidly fixed to the grinding-wheel carriage 23. On said supports are fixed two head-pieces 55, 56 having internal shapes 57, 58 which are also semi-cylindrical. Thus the grinding-wheel is not mounted on a shaft in overhung position but between two supports located substantially in vertically overhead relation to the slideways 22 of the grinding-wheel carriage 23.

Means are provided for facilitating the replacement of the grinding-wheel. With this objective, the two ends of the stationary shaft 49 also pass through the ends of the side-arms 61, 62 of a yoke 63, the body of which is essentially constituted by a casing 64 (as shown in FIG. 2). Said casing is attached to a horizontal transverse beam 65 in the form of an angle-iron member whch is fixed on the ends of two rocker-arms 67 located on each side of the grinding-wheel carriage 23. Only one rocker-arm is visible in FIG. 2 whereas the other rocker-arm is located on the other side of the machine. The yoke arm 61 carries a solid split hub 68 (as shown in FIG. 3) which forms a fastening collar for clamping the shaft 47 under the action of clamping screws 69 and is thus capable of temporarily supporting the grinding-wheel shaft in an overhung position during the wheel replacement operation. The other yoke arm 62 is removable and accordingly fixed for this purpose against the casing 64 by means of screws 72 (as shown in FIG. 2).

Figure 6:
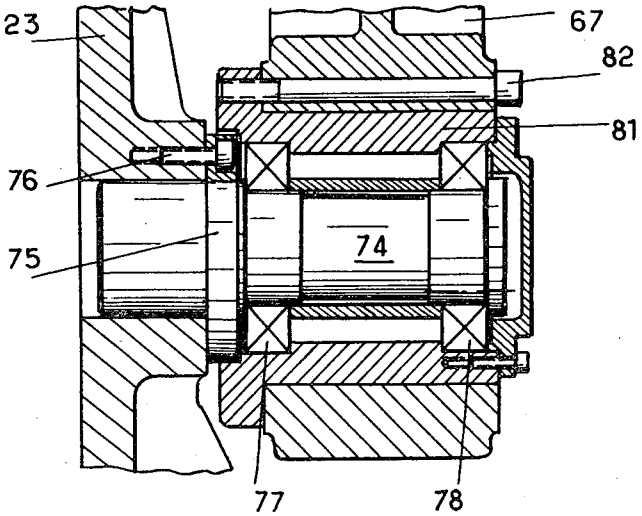
FIGS. 6 and 7 are part-sectional views also to a larger scale and taken along lines VI—VI and VII—VII of FIG. 2.

The method adopted for mounting each rocker-arm 67 on the corresponding lateral face of the grinding-wheel carriage is illustrated in detail in FIG. 6. This assembly accordingly comprises a pivot 74 provided with a flange 75 for coupling with the grinding-wheel carriage 23 by means of screws 76, two ball-bearings 77, 78 mounted on said pivot, and a shouldered sleeve 81 mounted on the two bearings and fixed within the arm 67 by means of screws 82.

The grinding-wheel 41 is driven in rotation by an electric motor 85 (FIGS. 1 and 2) carried by the casing 64 by means of a V-belt drive system 86 (FIG. 3). The belts (not shown) pass over a pulley 87 carried by the shaft of the motor and over a pulley 88 (FIG. 3) formed on one end of the sleeve 42 which carries the grinding-wheel. A cover 89 (FIG. 1) serves to protect the drive belts.

In FIG. 2, there is shown a resilient stop 92 which is fixed on one lateral face of the grinding-wheel carriage 23. The corresponding rocker-arm is intended to rest on said stop when the entire pivotal assembly (rocker-arm, yoke, grinding-wheel, motor) takes up the position shown in chain-dotted lines at 67' for replacement of the grinding-wheel. Another similar stop (not shown) is fixed against the other lateral face of the grinding-wheel carriage in order to receive the other rocker-arm.

As shown in FIGS. 2, 4 and 5, a dressing-wheel carriage 95 for truing the grinding-wheel is mounted on slideways 96 of the grinding-wheel carriage 23, said slideways being also located substantially in vertically overhead relation to the slideways 22 on which the grinding-wheel carriage 23 is slidably mounted. The movements of said dressing-wheel carriage are produced by means of a similar drive system comprising a stepping motor 101 having two directions of rotation, a reduction-gear unit 102, a screw 103, a nut 104 and a hydraulic jack 105.

Figure 7:
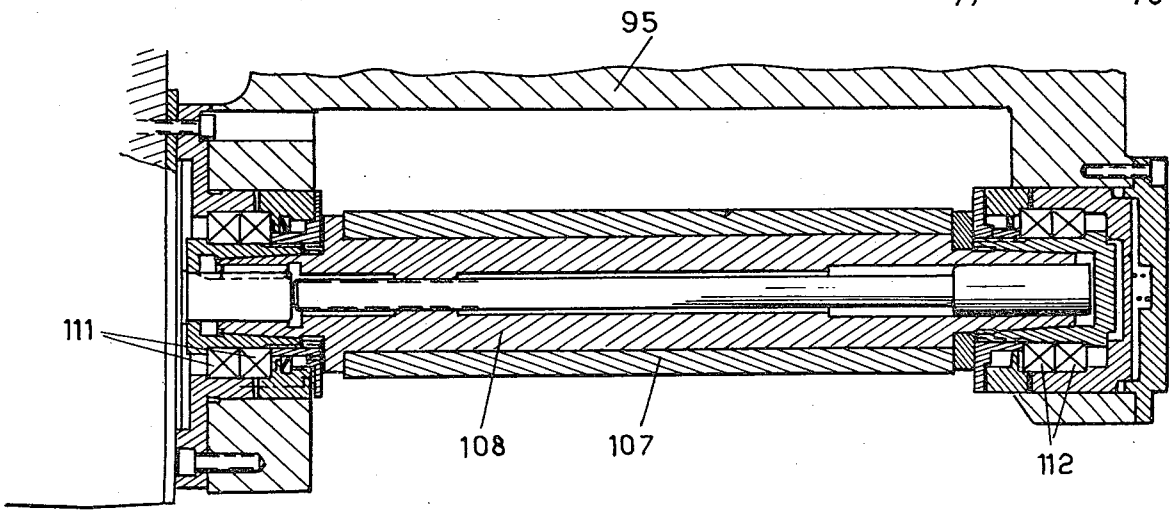

The dressing-wheel 107 (FIG. 7) is not mounted in overhung position in the carriage 95 but on a shaft 108 (as shown in FIG. 7), the two ends of which are rotatably mounted in two bearings 111, 112, with the result that the dressing-wheel is perfectly maintained on each side of the transverse mid-plane of the grinding-wheel.

The advantages attached to the design concept of this novel grinding machine will not be considered further since they have already been explained in the foregoing description.

When it is desired to replace one grinding-wheel by another wheel, the procedure is as follows: the initial operation consists in removing the head-pieces 55, 56 (shown in FIGS. 1, 2 and 4) by means of a hoisting appliance, whereupon the entire pivotal assembly (grinding-wheel 41, yoke 63, casing 64, motor 85 and rocker-arms 67) is rotated about the pivots 74 (shown in FIG. 6) in the direction of the arrow f (as shown in FIG. 2). In other words, the assembly is caused to pass above the machine and to return downwards at the rear end of the machine until the rocker-arms rest on their resilient stops 92 (shown in FIG. 2). The screws 72 are removed in order to permit removal of the detachable side-arm 62 of the yoke 63. It is then possible to remove the grinding-wheel which is located in a readily accessible and clean zone and to fit a fresh wheel in position. In order to restore the machine to a state of readiness for further operation, the removable yoke arm 62 is replaced and the pivotal assembly is rotated in the direction opposite to the arrow f until the two ends of the shaft 47 rest in their respective supports 51, 52 and the two head-pieces 55, 56 are again secured in such a manner as to ensure that the grinding-wheel shaft is perfectly maintained in position on the carriage 23.

As can readily be understood, the invention is not limited in any sense to the embodiment hereinabove described with reference to the accompanying drawings. Depending on the applications which are contemplated, many alternative forms can accordingly be devised by any one versed in the art without thereby departing either from the scope or the spirit of the invention.

We claim:

1. A grinding machine for finishing a workpiece, the combination of:

a stationary table, a grinding wheel carriage, and grinding wheel carriage slideways formed between the table and said carriage operable to provide carriage movement relative to the table toward and away from the workpiece;

a grinding wheel, a sleeve, and a shaft carried by said grinding wheel carriage, said sleeve being rotatably supported on the shaft medially thereof and said grinding wheel being secured on the sleeve to rotate therewith;

a pair of supports on the grinding wheel carriage positioned directly above said grinding wheel carriage slideways and spaced apart in the direction of the workpiece, and said shaft having end portions beyond the sleeve cooperating respectively with said supports, means operable to rotatably drive the grinding wheel relative to the carriage;

a dressing wheel, a dressing wheel carriage, means supporting said dressing wheel rotatably relative to the dressing wheel carriage, means operable to rotatably drive the dressing wheel relative to the dressing wheel carriage, and cooperating dressing wheel carriage slideways between the dressing wheel carriage and the grinding wheel carriage in a direction toward and away from said grinding wheel whereby the dressing wheel can be brought into operative engagement with the grinding wheel, said dressing wheel carriage slideways and said grinding wheel carriage slideways being generally aligned in direct vertical overhead relationship relative to one another and relative to said supports for said end portions of said shaft so as to minimize canting and deflection of the components relative one to another, said grinding machine further comprising a yoke casing, a rocker arm, and a side arm each distending from the yoke casing, securing means between the side arm and shaft holding them together, connection means between the rocker arm and the carriage at a location spaced from the supports operable to allow the yoke casing to be pivoted relative to the carriage between the operative position and an inoperative position whereat the shaft is removed and well spaced from the supports, and removable head pieces adapted to cooperate with the supports for holding the shaft relative to the supports in the operative position.

2. A grinding machine according to claim 1 wherein said drive means for the grinding wheel includes a motor drive means carried on the yoke casing, and a belt drive system between the motor drive means and the sleeve.

* * * * *